US006207597B1

(12) United States Patent
Ogita et al.

(10) Patent No.: US 6,207,597 B1
(45) Date of Patent: Mar. 27, 2001

(54) PRINTING BLANKET

(75) Inventors: Toshikazu Ogita, Miki; Seiji Tomono; Hiromasa Okubo, both of Kobe; Takamichi Sagawa, Akashi, all of (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/167,487

(22) Filed: Oct. 7, 1998

(30) Foreign Application Priority Data

Oct. 9, 1997 (JP) ..... 9-277769

(51) Int. Cl.[7] ..... D03D 15/00
(52) U.S. Cl. ..... 442/194; 428/909
(58) Field of Search ..... 442/194; 428/909

(56) References Cited

U.S. PATENT DOCUMENTS 3,887,750 * 6/1975 Duckett et al. ..... 428/297
5,643,660 * 7/1997 Price et al. ..... 442/192
5,934,192 * 8/1999 Ogita et al. ..... 101/217
6,074,735 * 6/2000 Ogita et al. ..... 428/222

FOREIGN PATENT DOCUMENTS 6-297877 10/1994 (JP) .

* cited by examiner

*Primary Examiner*—Terrel Morris
*Assistant Examiner*—Christopher C. Pratt
(74) *Attorney, Agent, or Firm*—Birch, Stewart, Kolasch & Birch, LLP

(57) ABSTRACT

A printing blanket according to the present invention is substantially composed of a base fabric and a surface printing layer, and a part or the whole of the base fabric is composed of hollow fibers. The printing blanket is superior in productivity because it has a simpler structure than that of an air-type printing blanket, and has excellent compression properties similar to those of the air-type printing blanket.

13 Claims, 7 Drawing Sheets

PRINTING BLANKET

BACKGROUND OF THE INVENTION

1. Field of the Invention

The present invention relates to a sheet-shaped printing blanket which is used for winding around a blanket cylinder of an offset printing press.

2. Description of the Prior Art

The printing blanket generally has a structure wherein a surface printing layer made of an elastomer such as rubber is laminated on at least one base fabric.

To cope with an increase in speed of printing presses and an improvement in quality of printed images, there has recently been popularized a so-called air-type printing blanket having a porous compressible layer made of an elastomer such as rubber, for instance, which is interposed between the above base fabric and surface printing layer.

The above air-type printing blanket is lower in compressive stress in a nip deformed portion produced by being pressed against a plate cylinder, as compared with a conventional printing blanket having no compressible layer (normally referred to as a solid-type printing blanket) and is also lower in a fluctuation in compressive stress with respect to the change in amount of distortion at the above nip deformed portion. Therefore, the air-type blanket is generally high in impact absorbability.

Accordingly, the air-type blanket is superior in preventing impact produced by the feeding gears of the printing press or impact produced at the time when the joint of the blanket wound around the blanket cylinder passes through the pressed portion against the plate cylinder, for example, from affecting printing precision.

The solid-type printing blanket causes a so-called bulge by stress concentrations on the surface printing layer in the nip deformed portion, which might result in inferior printing such as out of register due to expansion in the circumferential direction, inferior paper feeding, double, or deformation of a dot pattern (particularly, dot gain).

On the other hand, the air-type printing blanket also has the effect of preventing the above-mentioned inferior printing because the compressible layer has the function of lowering stress concentrations on the surface printing layer, thereby inhibiting expansion of the surface printing layer in the circumferential direction.

The examples include a compressible layer having a closed cell structure in which voids are independent of each other, which is formed by (a) foaming matrix rubber constituting the compressible layer by an expanding agent which is decomposed by heating to emit gas, or (b) blending a hollow microsphere with matrix rubber, for example, and a compressible layer having an open cell structure in which voids connect with each other, which is formed by (c) a so-called leaching method for dispersing particles such as common salt particles, extractable by a solvent (water in the case of the common salt particles) which does not affect rubber, in matrix rubber, vulcanizing the matrix rubber, and then extracting the particles.

In order to form the compressible layer, however, a lot of complicated steps are required even in the printing blanket having either one of the structures as described above and, furthermore, the size of the cell structure is liable to vary. Therefore, the air-type printing blanket is lower in productivity than the solid-type printing blanket.

SUMMARY OF THE INVENTION

An object of the present invention is to provide a novel printing blanket which is superior in productivity because it has a simpler structure than that of an air-type printing blanket, and has excellent compression properties similar to those of the air-type printing blanket.

To accomplish such an object, a sheet-shaped printing blanket according to the present invention comprises substantially a surface printing layer and at least one base fabrics, at least one of the base fabric being composed of a hollow fiber in whole or in part.

The description "comprises substantially a surface printing layer and a base fabric" means that the printing blanket according to the present invention has a structure similar to that of a conventional solid-type printing blanket containing no compressible layer. For example, it is not intended to eliminate use of an auxiliary component such as adhesive containing a vulcanizable rubber (so-called vulcanizable adhesive) for bonding the base fabric and surface printing layer or bonding base fabrics when two or more base fabrics are laminated each other.

In the printing blanket according to the present invention, a cavity in the hollow fiber constituting a part or the whole of the base fabric functions similarly to the voids in the conventional compressible layer, whereby the compressible layer can be omitted.

Therefore, the printing blanket according to the present invention is superior in productivity because it has a laminated structure which is simpler than that of an air-type printing blanket and is substantially the same as that of a solid-type printing blanket, and has excellent compression properties similar to those of the air-type printing blanket.

On the basis of the same thought as that of the present invention, that is, the thought of improving the structure of the base fabric while omitting the compressible layer to obtain compression properties similar to those of the air-type printing blanket, for example, Japanese Examined Patent Publication No. 55519/1987 discloses a printing blanket using, as a base fabric, a three-dimensional woven fabric woven by using warp and weft yarns and a vertical yarn extending directly in the orientation direction of both these yarns.

However, the above-mentioned printing blanket is superior in compression properties in the initial stage of use as is apparent from the results of the examples and comparative examples mentioned later, but is insufficient in durability as compared with that of the present invention. Therefore, it causes a problem that so-called setting arises because flex deformation of the vertical yarn is remained as permanent set when printing is continuously performed, resulting in large fluctuation (deterioration) of compression properties.

Claim 1 of Japanese Laid-Open Patent Publication No. 297877/1994 discloses a printing blanket using, as a base fabric, those produced by laminating a mixed or twist yarn made of a high-tension fiber, obtained by cutting a high-tension chemical fiber into pieces of 10 to 30 cm in length, and an arbitrary short fiber of about 5 cm or less in length.

However, such a base fabric is produced without considering that a function of the compressible layer is imparted to the base fabric. Therefore, a printing blanket using such a base fabric is superior in durability in repeat use as is apparent from the results of the examples and comparative examples mentioned later, but good compression properties similar to those of the printing blanket of the present invention can not be obtained even in the initial stage of use.

Claim 2 of Japanese Laid-Open Patent Publication No. 297877/1994 discloses to improve compression properties of a printing blanket by using the above-mentioned base fabric in combination with the above-mentioned three-dimensional woven fabric. In this case, the structure is complicated and the durability of the printing blanket becomes insufficient similar to those described in the above-mentioned publications, resulting in large fluctuation (deterioration) of compression properties at the time of continuous printing.

Regarding the hollow fiber used in the present invention, since the cavity itself functions similar to the voids in the conventional compressible layer as mentioned above, there can be used, as a base fabric containing said hollow fiber, those which are easily produced and have a simple construction, for example, textile having a simple weave design such as plain weave, nonwoven fabric or the like.

On the other hand, the three-dimensional woven fabric used in both publications mentioned above must be produced by using an exclusive special weaving machine and the productivity is low.

Therefore, even in case of the construction disclosed in any publication, it is impossible to exert excellent effect similar to that of the printing blanket according to the present invention.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
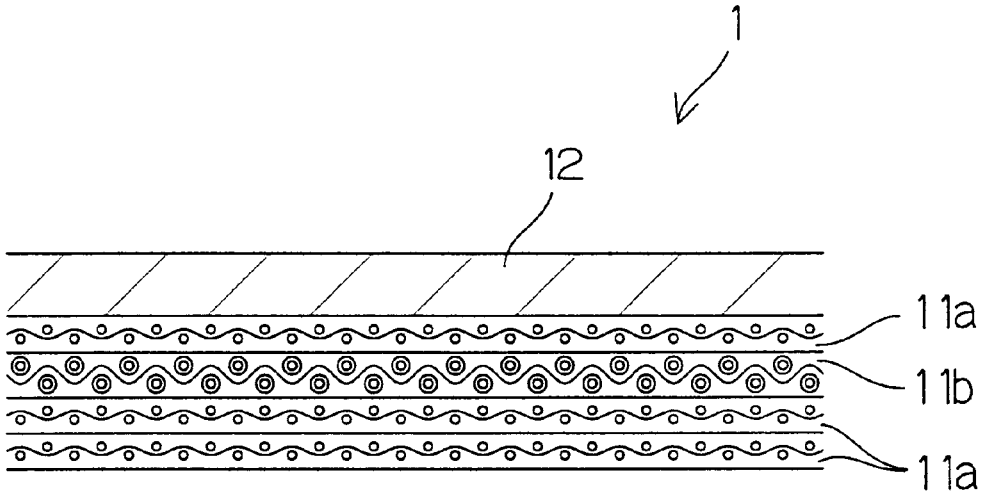
FIG. 1 is a diagram showing one embodiment of a printing blanket according to the present invention, where FIG. 1(*a*) is a partially enlarged sectional view, and FIG. 1(*b*) is an enlarged sectional view of a base fabric woven by using warp and weft yarns as the principal part.
Figure 1:
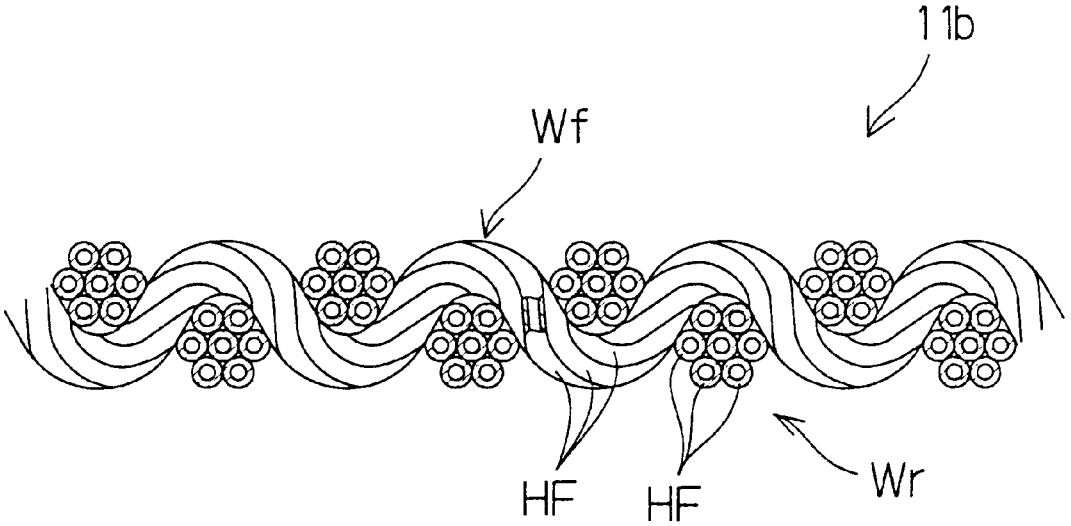

Referring now to the drawings, the present invention will be described.

First, the embodiment of FIG. 1(*a*), FIG. 1(*b*) and FIG. 2 will be described.

Figure 2:
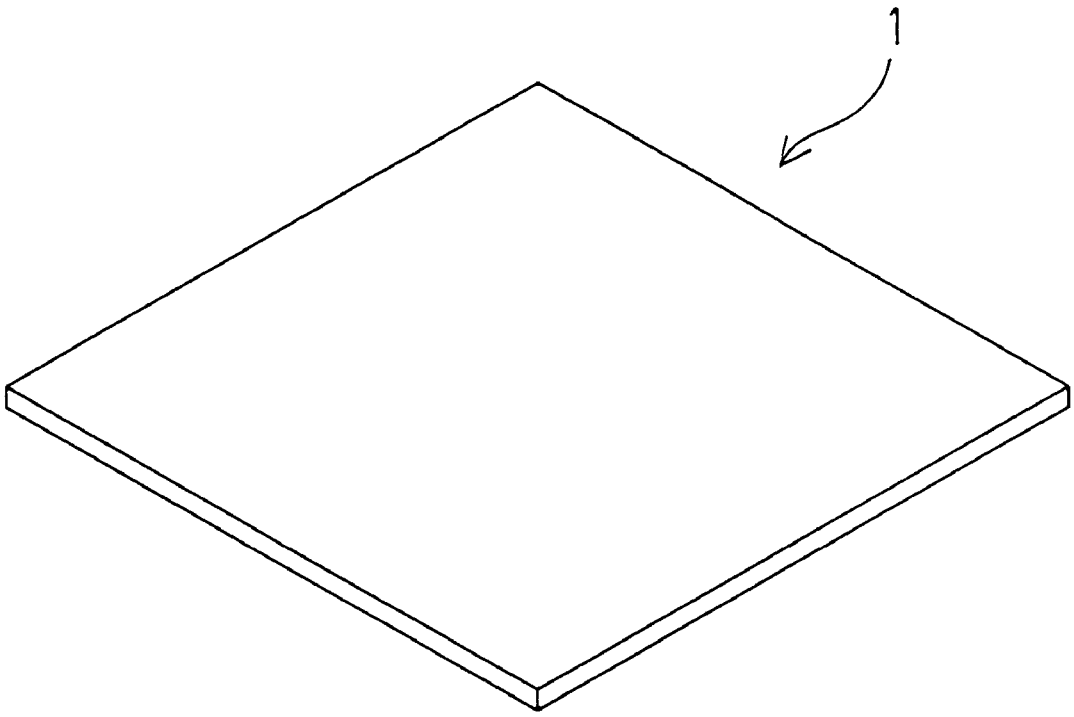
FIG. 2 is a perspective view showing the whole of the printing blanket according to the above-mentioned embodiment.

A printing blanket 1 according to this embodiment has a five-layer structure wherein four base fabrics 11*a*, 11*b*, . . . are laminated and a surface printing layer 12 is laminated thereon, as shown in FIG. 1(*a*), and the whole is formed in a shape of a sheet, as shown in FIG. 2.

Among them, four base fabrics 11*a*, 11*b*, . . . are respectively a base fabric composed only of a normal non-hollow fiber (normal base fabric) 11*a*, a base fabric containing a hollow fabric 11*b*, a normal base fabric 11*a* and a normal base fabric 11*a* in this order, as shown in the drawing.

Among them, as the base fabric 11*b* containing the hollow fiber, for example, a woven fabric produced by knitting, weaving or looming a yarn, obtained by twisting at least one of a warp yarn Wr and a weft yarn Wf (both yarns in FIG. 1(*b*)) together with a hollow fiber HF, as shown in FIG. 1(*b*), is used.

Although both of the warp yarn Wr and weft yarn Wf used in the embodiment of the drawing are constructed by twisting together with a plurality of hollow fibers HF, a monofilament follow fiber may also be used in one or both of them. Those obtained by mixing the hollow fiber HF with a normal fiber may also be used in one or both of the warp yarn Wr and weft yarn Wf.

The above-mentioned textile has such an advantage that not only compression properties of the printing blanket 1 can be minutely adjusted but also compression properties can be made almost uniform over the whole of the printing blanket 1 by changing the size and number of twist of the hollow fiber HF constituting the warp yarn Wr and/or weft yarn Wf, or using the hollow fiber HF in either one of the warp yarn Wr or weft yarn Wf and using a normal non-hollow fiber in the other.

The weave design of the base fabric 11*b* is not specifically limited, but a basic/simple weave design such as so-called plain weave of allowing to intersect one warp yarn Wr and one weft yarn Wf each other, twill weave, stain weave or the like is preferably employed, taking ease of production into consideration as mentioned above.

As the base fabric 11*b*, there can be used a so-called nonwoven fabric produced by irregularly arranging or entangling the hollow fibers using a means such as adhesive, heating under pressure or the like.

Figure 3:
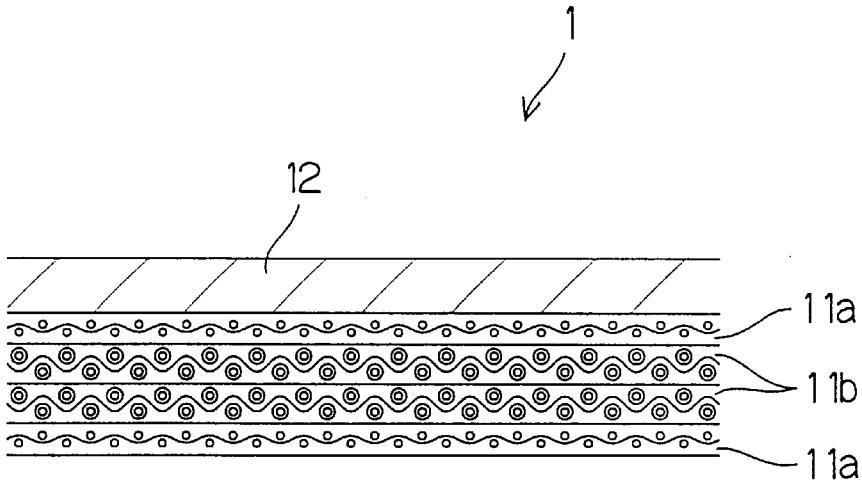
FIG. 3(*a*) to FIG. 3(*c*) are respectively a partially enlarged sectional view showing another embodiment of the printing blanket according to the present invention.
Figure 3:
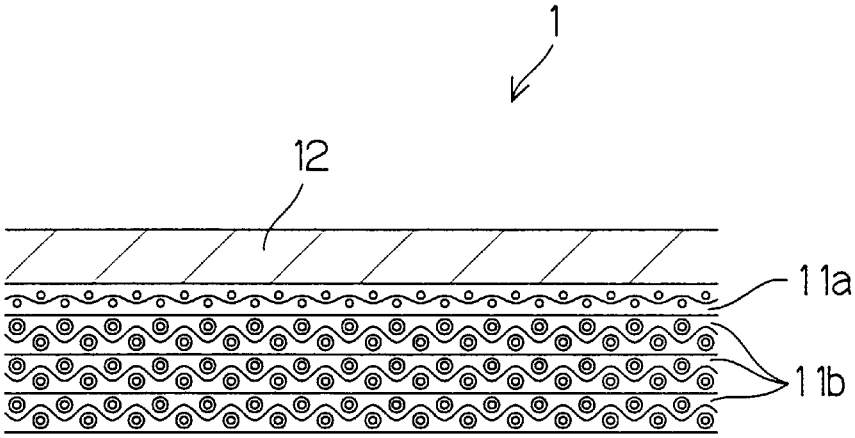
Figure 3:
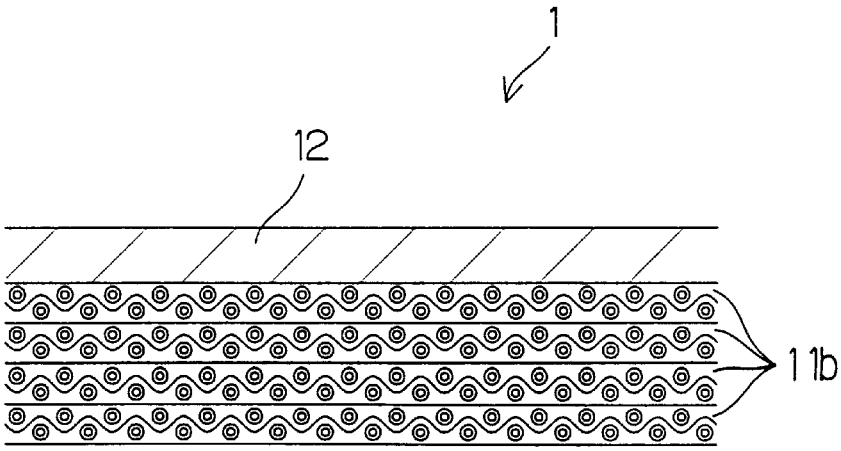

To largely change compression properties of the printing blanket 1, for example, the number of the base fabric 11*b* containing the hollow fiber may be changed, as shown in FIG. 3(*a*) to FIG. 3(*c*).

Among them, a printing blanket 1 of FIG. 3(*a*) is formed by using a base fabric 11*b* containing a hollow fiber as middle two base fabrics out of four base fabrics and using a normal base fabric 11*a* as top and bottom base fabrics. A printing blanket 1 of FIG. 3(*b*) is formed by using a base fabric 11*b* containing a hollow fiber as lower three base fabrics out of four base fabrics and using a normal base fabric 11*a* as only one top base fabric. A printing blanket 1 of FIG. 3(*c*) is formed by using a base fabric 11*b* containing a hollow fiber as all of four base fabrics.

In such way, as the number of the base fabric 11*b* containing the hollow fiber increases, a compression stress to the amount of distortion can be reduced and a fluctuation in compression stress with a change in amount of distortion can be reduced. Therefore, the impact absorbability of the printing blanket 1 is further enhanced.

When the number of the base fabric 11*b* containing the hollow fiber becomes five or more, the compression stress becomes too small and, therefore, the solid applicability of ink is likely to be lowered. Since the number of lamination of the base fabrics increases, the productivity is likely to be lowered. Therefore, the number of the base fabric 11*b* containing the hollow fiber is preferably from about 1 to 4.

The total thickness of the base fabric 11*b* containing the hollow fiber (thickness of the base fiber in case of one base fabric) is not specifically limited, but is preferably from about 0.1 to 1.5 mm.

When the total thickness of the base fabric is smaller than the above range, compression properties of the printing blanket are likely to be lowered.

On the other hand, when the total thickness exceeds the above range, the solid applicability of ink is likely to be lowered because the compression stress becomes too small.

Within the above range, it is preferred that the total thickness of the base fabric 11*b* containing the hollow fiber is from 0.5 to 1.5 mm, more preferable, 0.5 to 1.3 mm.

As the hollow fiber HF contained in the above-mentioned base fabric 11*b*, all of a variety of conventionally known chemical fibers made of regenerated fiber, semi-synthetic fiber and synthetic fiber each having a cavity within can be used.

For example, in case of the embodiment of the drawing, each hollow fiber, which is circular in outer cross section and has only one cavity circular in cross section continuously provided along its length in its central part, is used. Such a hollow fiber has such an advantage that stress properties with respect to compression are uniform. However, each of the shapes of the outer cross section and the cross section of the cavity may be various shapes other than a circle. The number of cavities is not limited to one. Two or more cavities may be so formed as to be parallel to each other. Further, the cavities may be continuous but intermittent.

Examples of the polymer constituting the hollow fiber include polyester, acrylic resin, rayon, nylon, and aromatic polyamide.

The size of the hollow fiber is not specifically limited, and may be suitably set depending on the number of twist. In the case of only one cavity formed in the central part of the hollow fiber as shown, however, the outer diameter is normally from about 10 to 50 $\mu$m and the inner diameter is preferably from about 5 to 30 $\mu$m.

Specific examples of the hollow fiber include those disclosed in Japanese Laid-Open Patent Publication Nos. 350028/1978, 50620/1979, 61717/1982, 175110/1988, 90613/1991, etc., or "NEW S-UP" available from TOYOBO CO., LTD., "RX 21" available from TOYOBO CO., LTD., triangular hollow fiber for a carpet available from TOYOBO CO., LTD., triangular hollow fiber for a carpet available from Asahi Chemical Industry Co., Ltd., and square hollow fiber for a carpet available from Asahi Chemical Industry Co., Ltd., which are not limitations.

The base fabric 11*a* and surface printing layer 12 which together with the base fabric 11*b* containing the hollow fiber, constitute the printing blanket 1, can be respectively constructed similar to those in the conventional example.

For example, as the normal base fabric 11*a*, a textile or a nonwoven fabric made of cotton, polyester, rayon or the like is used. The thickness of the base fabric 11*a* may be the same degree of the conventional example, that is, about 0.2 to 0.6 mm.

The surface printing layer 12 is formed by vulcanizing an unvulcanized rubber layer, which is formed by applying a rubber cement prepared for said surface printing layer and drying the rubber cement, or an unvulcanized rubber layer molded into a sheet from a rubber compound for surface printing layer.

As the rubber composing the surface printing layer 12, oil-resistant rubber having resistance to ink or washing solvent, such as acrylonitrile-butadiene copolymer rubber (NBR), chloroprene rubber (CR), or urethane rubber (U), is suitably used. In addition thereto, polysulfide rubber (T), hydrogenated NBR, or the like can be used.

The thickness of the surface printing layer is preferably the same as that in the conventional example, that is, about 0.2 to 0.6 mm.

The printing blanket 1 with the above-mentioned respective layers is produced by laminating the respective base fabrics 11*a*, 11*b* through the above-mentioned vulcanizing adhesive, specifically in the state where the vulcanizing adhesive is spread over the base fabric, laminating an unvulcanized rubber layer as a basis of the above-mentioned surface printing layer through the vulcanizing adhesive or directly thereon to form a laminate, and then heating the laminate under pressure, thereby to vulcanize the vulcanizing adhesive and rubber layer.

Each layer may be vulcanized every time it is formed. However, it is suitable in view of the productivity that all of layers may be vulcanized all at once.

Among the above-mentioned respective layers, both the surface printing layer 12 and vulcanizing adhesive are not porous in view of improving the productivity of the printing blanket by simplification of the steps and elimination of uneven quality.

The produced sheet-shaped printing blanket 1 is used upon being mounted on the blanket cylinder of the offset printing press in the state of being wound and bonded onto the blanket cylinder axis of the offset printing press, directly or through a lining material.

As the rubber composing the vulcanizing adhesive, the above-mentioned oil-resistant rubber such as NBR, CR, U or the like can be suitably used taking the resistance to ink into consideration, similar to the surface printing layer.

Various types of additives can be blended with the above-mentioned vulcanizing adhesive, or the rubber compound or the rubber cement for a surface printing layer 12.

Examples of such additives include an antioxidant, a reinforcer, a filler, a softener, and a plasticizer in addition to compounds for vulcanizing rubber such as a vulcanizing agent, a vulcanization accelerator, activator, and a retarder. The amount of addition of the additive may be approximately the same as that in the conventional example.

Examples of the above-mentioned vulcanizing agent include sulfur, an organic sulfur compound, and an organic peroxide. Examples of the organic sulfur compound include N,N'-dithiobismorpholine. Examples of the organic peroxide include benzoyl peroxide and dicumyl peroxide.

Examples of the vulcanization accelerator include organic accelerators such as thiuram vulcanization accelerators such as tetramethylthiuramdisulfide and tetramethylthiuramammoniumsulfide; dithiocarbamic acids such as zinc dibutyldithiocarbamate, zinc diethyldithiocarbamate, sodium dimethyldithiocarbamate, and tellurium diethyldithiocarbamate; thiazoles such as 2-mercaptobenzothiazole and N-cyclohexyl-2-benzothiazolesulfenamide; and thioureas such as trimethylthiourea and N,N'-diethylthiourea, or inorganic accelerators such as slaked lime, magnesium oxide, titanium oxide, and litharge (PbO).

Examples of the activator include metal oxides such as zinc oxide, or fatty acids such as stearic acid, oleic acid, and cottonseed fatty acid.

Examples of the retardant include aromatic organic acids such as salicylic acid, phthalic anhydride, and benozic acid; and nitroso compounds such as N-nitrosodiphenylamine, N-nitroso-2,2,4-trimethyl-1,2-dihydroquinone, and N-nitrosophenyl-β-naphtylamine.

Examples of the antioxidant include imidazoles such as 2-mercaptobenzimidazole; amines such as phenyl-α-naphthylamine, N,N'-di-β-naphthyl-p-phenylenediamine, and N-phenyl-N'-isopropyl-p-phenylenediamine; and phenols such as di-t-butyl-p-cresol and styrenated phenol.

As the reinforcer, carbon black is mainly used. Further examples of the reinforcer include inorganic reinforcers such as silica or silicate white carbon, zinc oxide, surface treated precipitated calcium carbonate, magnesium carbonate, talc, and clay, or organic reinforcers such as coumarone-indene resin, phenol resin, and high styrene resin (a styrene-butadiene copolymer having a large styrene content).

Examples of the filler include inorganic fillers such as calcium carbonate, clay, barium sulfate, diatomaceous earth, mica, asbestos, and graphite, or organic fillers such as reclaimed rubber, rubber powder, asphalts, styrene resin, and glue.

Examples of the softener include various softeners of a vegetable oil, a mineral oil and a synthetic oil such as fatty acids (stearic acid, lauric acid, etc.), cottonseed oil, tall oil, asphalts, and paraffin wax.

Examples of the plasticizer include various plasticizers such as dibutyl phthalate, dioctyl phthalate, and tricresyl phosphate.

In addition thereto, a tackifier, a dispersant, a solvent, or the like may be suitably blended with rubber.

The construction of the printing blanket according to the present invention is not limited to that in the above-mentioned embodiment. Various design changes can be made in the range in which the gist of the present invention is not changed.

The total number of the base fabric is not limited to four, and the total number of the base fabric may be three or less, or five or more so far as at least one base fabric 11*b* containing the hollow fiber is contained therein. When the total number of the base fabric is five or more, the number of the base fabric 11*b* containing the hollow fiber is preferably four or less for the above-mentioned reason.

Figure 4:
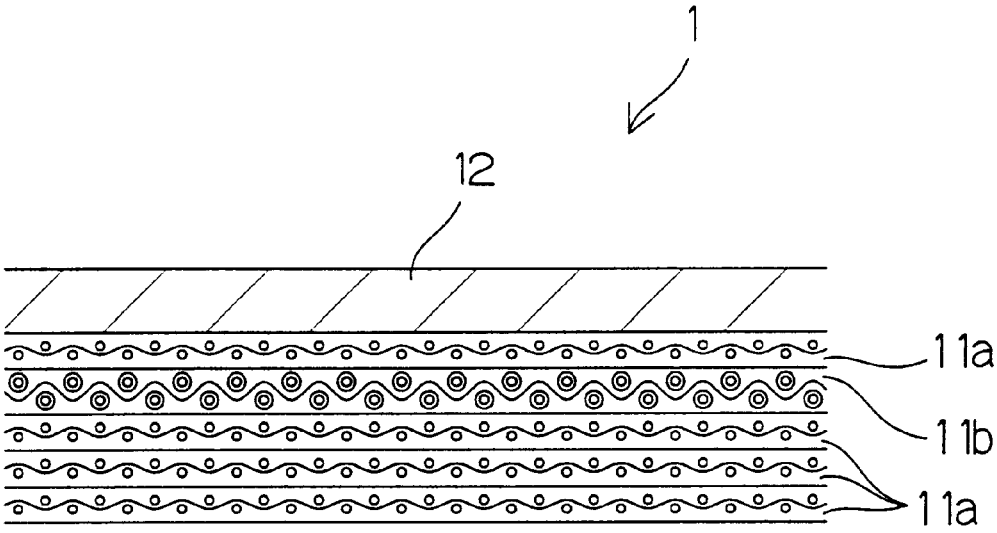
FIG. 4(*a*) and FIG. 4(*b*) are respectively a partially enlarged sectional view showing another embodiment of the printing blanket according to the present invention.
Figure 4:
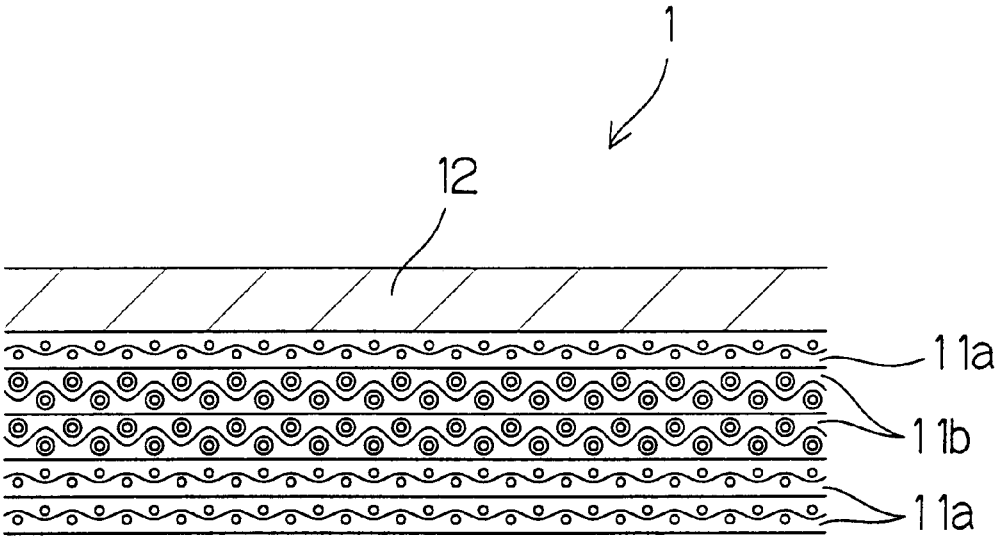
Figure 5:
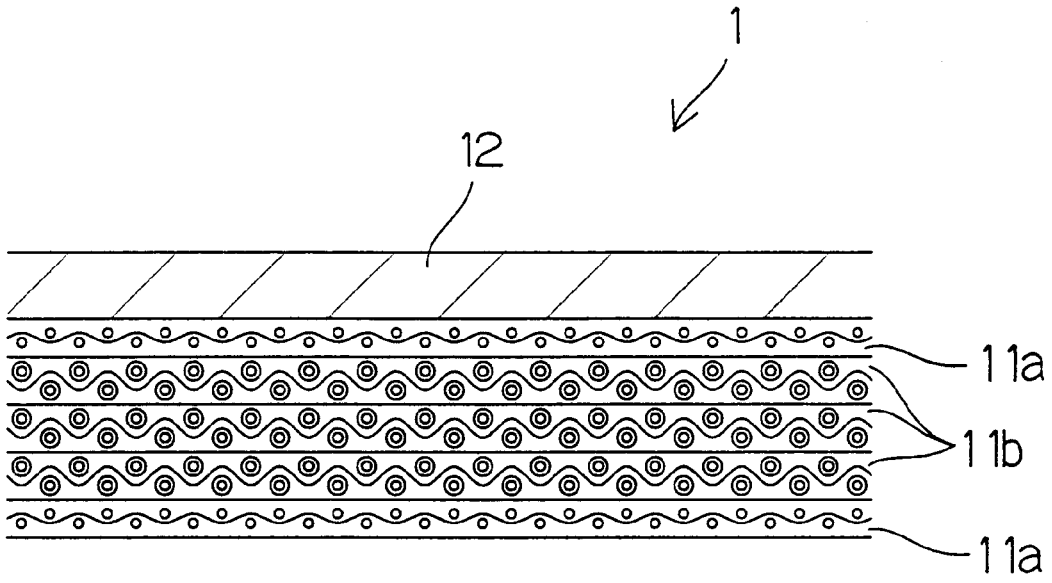
FIG. 5(*a*) to FIG. 5(*c*) are respectively a partially enlarged sectional view further showing another embodiment of the printing blanket according to the present invention.
Figure 5:
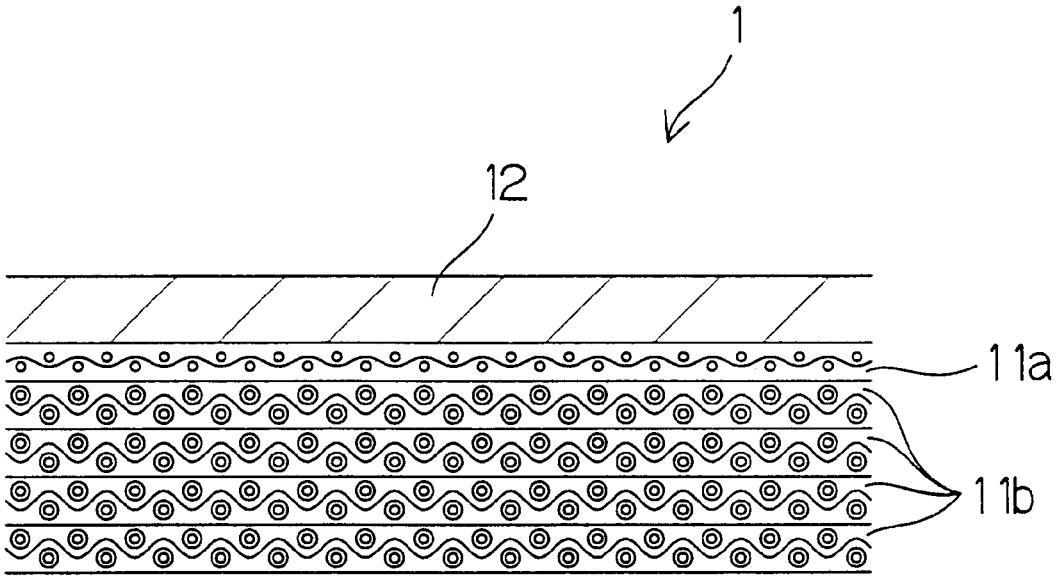

For example, FIGS. 4(*a*), 4(*b*) and FIGS. 5(*a*), 5(*b*) respectively show an embodiment wherein the total number of the base fabric is five. Among them, FIG. 4(*a*) shows an embodiment wherein the second base fabric from the top out of five base fabrics is composed of a base fabric 11*b* containing a hollow fiber and the other four base fabrics are composed of a normal base fabric 11*a*. FIG. 4(*b*) shows an embodiment wherein the second and third base fabrics from the top out of five base fabrics are composed of a base fabric 11*b* containing a hollow fiber and the other three base fabrics are composed of a normal base fabric 11*a*. Furthermore, FIG. 5(*a*) shows an embodiment wherein three middle base fabrics out of five base fabrics are composed of a base fabric 11*b* containing a hollow fiber and the top and bottom base fabrics are composed of a normal base fabric 11*a*. FIG. 5(*b*) shows an embodiment wherein four base fabrics from the bottom out of five base fabrics are composed of a base fabric 11*b* containing a hollow fiber and only the top base fabric is composed of a normal base fabric 11*a*.

In addition thereto, the arrangement and construction of the respective layers constituting the printing blanket 1 can be suitably changed.

In short, if the hollow fiber is contained in the base fabric in place of the omission of a conventional compressible layer, the other construction is not particularly limited in the sheet-shaped printing blanket.

As described in detail in the foregoing, according to the present invention, there can be provided a printing blanket which is superior in productivity because it has a laminated structure which is simpler than that of an air-type printing blanket and is substantially the same as that of a solid-type printing blanket, and has excellent compression properties similar to those of the air-type printing blanket.

EXAMPLES

The following examples and comparative examples further illustrate the present invention in detail.

Example 1

Using a hollow fiber made of polyester which is circular in cross section and has only one cavity circular in cross section provided continuously along its length in its central part [NEW S-UP available from TOYOBO CO., LTD.; 20 μm in outside diameter and 10 μm in inside diameter at the cavity], a warp yarn made by twisting three hollow fibers and a weft yarn made by twisting fifteen yarns, a base fabric having a thickness of 0.4 mm was made by plain weaving.

One base fabric mentioned above and three cotton cloths having a thickness of 0.3 mm as a normal base fabric were laminated by spreading over a vulcanizing adhesive containing NBR, and then a rubber cement for a surface printing layer containing NBR was spread over the base fabric constituting the outermost layer and dried.

After the whole laminate was vulcanized by heating under pressure using a curing pan, the surface of the surface printing layer was polished to produce a sheet-shaped printing blanket having a laminated structure shown in FIG. 1(*a*), wherein the thickness of the surface printing layer is 0.4 mm, the total thickness is 1.7 mm, the number of the base fabric woven by using the hollow fiber is one, and the total thickness of the base fabric is 0.4 mm.

Example 2

A sheet-shaped printing blanket having a laminated structure shown in FIG. 3(*a*), wherein the thickness of the surface printing layer is 0.4 mm, the total thickness is 1.8 mm, the number of the base fabric woven by using the hollow fiber is two, and the total thickness of the base fabric is 0.8 mm, was produced in the same mariner as that in Example 1 except that two base fabrics woven by using the hollow fiber having a thickness of 0.4 mm and two cotton cloths having a thickness of 0.3 mm as a normal base fabric were laminated by spreading over a vulcanizing adhesive containing NBR.

Example 3

A sheet-shaped printing blanket having a laminated structure shown in FIG. 3(*b*), wherein the thickness of the surface printing layer is 0.4 mm, the total thickness is 1.9 mm, the number of the base fabric woven by using the hollow fiber is three, and the total thickness of the base fabric is 1.2 mm, was produced in the same manner as that in Example 1 except that three base fabrics woven by using the hollow fiber having a thickness of 0.4 mm and one cotton cloth having a thickness of 0.3 mm as a normal base fabric were laminated by spreading over a vulcanizing adhesive containing NBR.

Comparative Example 1

A sheet-shaped printing blanket having a conventional solid-type structure, wherein the thickness of the surface printing layer is 0.4 mm and the total thickness is 1.6 mm, was produced in the same manner as that in Example 1 except that all of four base fabrics were composed of a cotton cloth having a thickness of 0.3 mm as a normal base fabric.

Comparative Example 2

Three cotton cloths having a thickness of 0.3 mm as a normal base fabric were laminated by spreading over a vulcanizing adhesive containing NBR, and then a rubber cement for a compressible layer containing NBR and particles (particle diameter: 1 to 100 $\mu$m) of common salt was spread over the base fabric constituting the outermost layer and dried.

This laminate was vulcanized by heating under pressure, subjected to a leaching treatment of extracting particles of common salt by immersing in a hot water at 70° C. for 6 hours, and then dried to form a compressible layer of 0.3 mm in thickness having an open cell structure.

A vulcanizing adhesive containing NBR was spread over one cotton cloth having a thickness of 0.3 mm as the same normal base fabric as described above. The cotton cloth was laminated on the compressible layer of the laminate, and then the same vulcanizing adhesive containing NBR and a rubber cement for a surface printing layer containing NBR were spread thereon in this order and dried.

After the whole laminate was vulcanized by heating under pressure using a curing pan, the surface of the surface printing layer was polished to produce a sheet-shaped printing blanket having a conventional air-type structure, wherein the thickness of the surface printing layer is 0.4 mm and the total thickness is 1.9 mm.

Comparative Example 3

To reproduce the printing blanket disclosed in the above-mentioned Japanese Examined Patent Publication No. 55519/1987, a three-dimensional woven fabric having a thickness of 1.5 mm was woven by using a yarn (No.60 count) made of a non-hollow normal polyester fiber as a warp yarn, a weft yarn and a vertical yarn.

Then, a vulcanizing adhesive containing NBR and a rubber cement for a surface printing layer containing NBR were spread on this three-dimensional woven fabric as the base fabric in this order and dried. After the whole laminate was vulcanized by heating under pressure using a curing pan, the surface of the surface printing layer was polished to produce a sheet-shaped printing blanket having a two-layer structure disclosed in FIG. 5 of the above publication, wherein the thickness of the surface printing layer is 0.4 mm and the total thickness is 1.9 mm.

Comparative Example 4

To reproduce the printing blanket disclosed in claim 1 of the above-mentioned Japanese Laid-Open Patent Publication No. 297877/1994, a plain-woven base fabric having a thickness of 0.4 mm was woven by using, as a warp yarn and a weft yarn, a yarn (No.60 count) made by mixing a high-tension fiber, obtained by cutting an Aramid fiber (Kevlar available from Du Pont Co.) as a high-tension chemical fiber into pieces of about 10 to 30 cm in length, and a short fiber obtained by cutting the same fiber into pieces of about 5 cm or less in length.

Then, a sheet-shaped printing blanket, wherein the thickness of the surface printing layer is 0.4 mm and the total thickness is 1.7 mm, was produced in the same manner as that in Example 1 except that such a base fabric was used in place of a base woven by using the hollow fiber.

The following tests were conducted with respect to each of the printing blankets produced in the above-mentioned examples and comparative examples, to evaluate the properties thereof.

Test for compression properties (initial)

Figure 6:
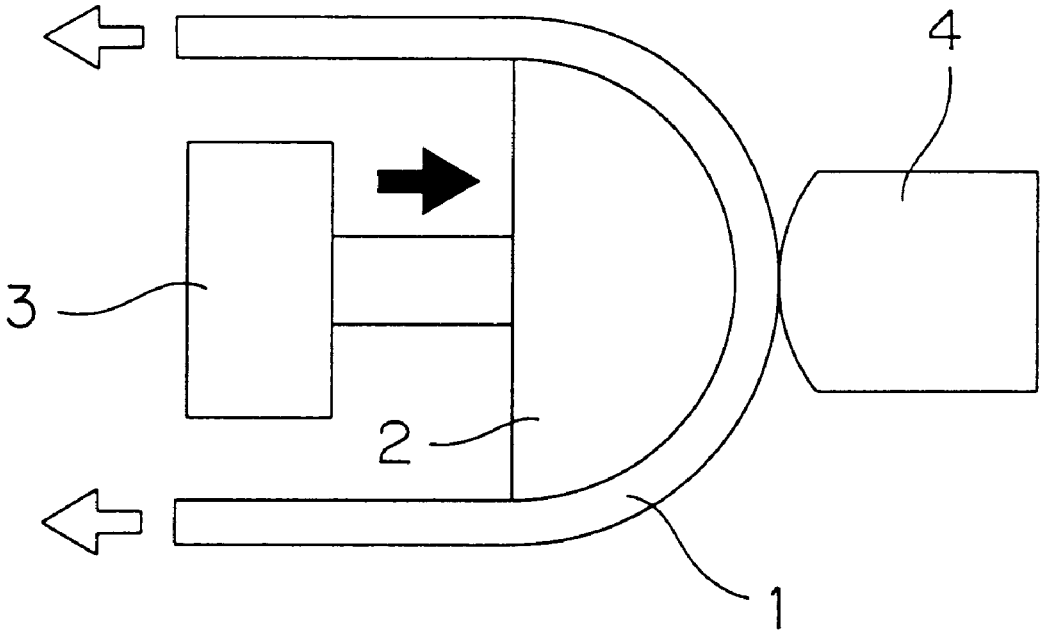
FIG. 6 is a front view of an apparatus for measuring the compression properties of printing blankets produced in example and comparative examples.

As shown in FIG. 6, when in a state where the central part of each of the not yet used printing blankets 1 just after produced in the examples and comparative examples was arranged in contact with the surface of a mounting cylinder 2 semi-circular in cross section serving as a model of a blanket cylinder of an offset printing press and both ends thereof are stretched with a tensile force in the direction indicated by the white arrow in the drawing, the above mounting cylinder 2 was transferred to the direction indicated by the black arrow in the drawing by using a piston 3 to press against an impression cylinder 4 serving as a model of a plate cylinder, thereby distorting the printing blanket 1, initial compressive stress (kgf) produced depending on the amount of the distortion (mm) in the thickness direction.

Test for compression properties (after repeated compression)

In a state where each of the printing blankets of the examples and comparative examples was wound and bonded around the blanket cylinder and mounted to a blanket cylinder axis of an offset printing press (Model 560 available from RYOBI LIMITED) and, at the same time, a plate cylinder was pressed against the printing blanket in the amount of depression of 0.15 mm, the cylinder was rotated 5,000,000 times at a rotational speed of 500 rpm and the compressive stress (kgf) after the repeated compression was measured in the same manner as that described above.

Figure 7:
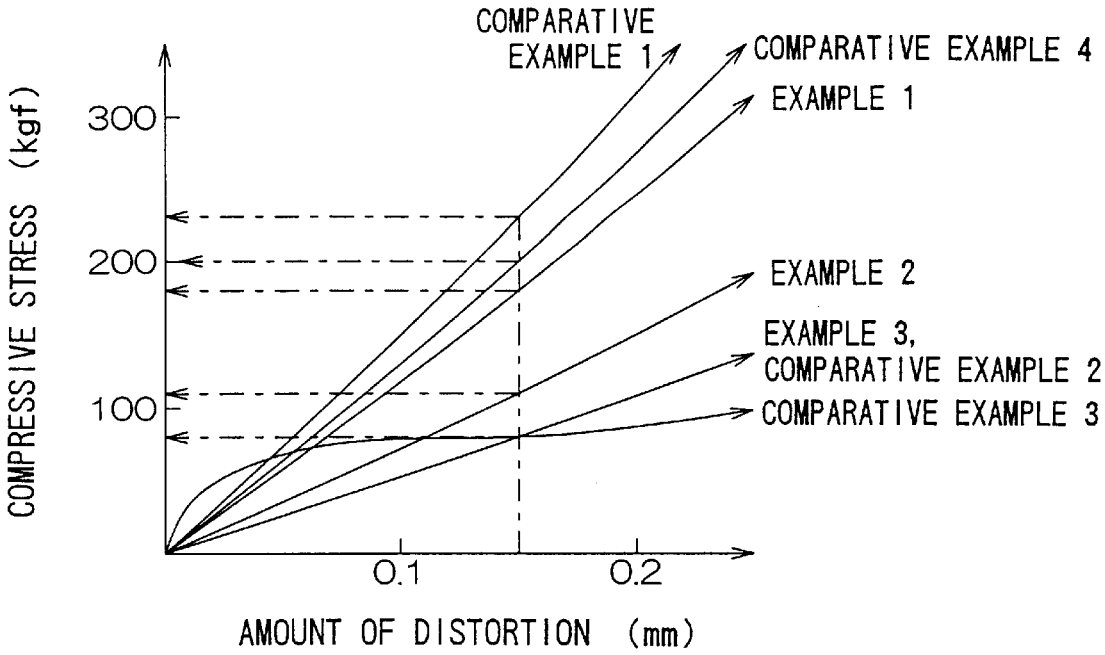
FIG. 7 is a graph showing the relationship between the amount of distortion and compressive stress in the printing blankets in examples and comparative examples.
Figure 7:
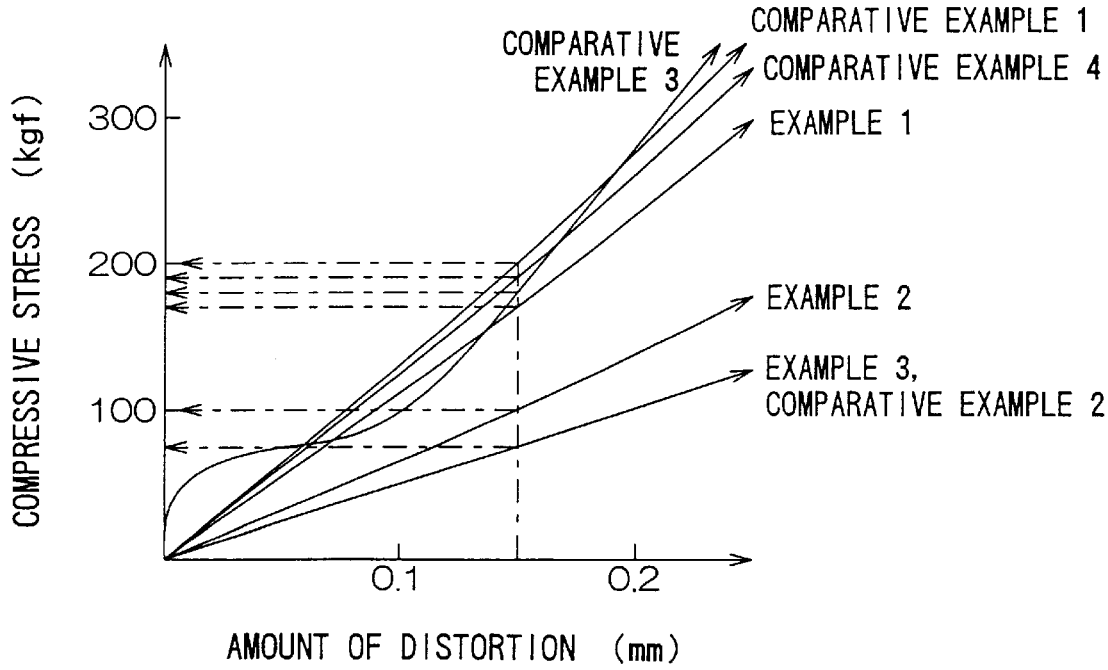

The initial results are shown in FIG. 7(*a*) and results after repeated compression are shown in FIG. 7(*b*).

As is apparent from these drawings, the printing blanket of Comparative Example 1 as a conventional solid-type printing blanket and the printing blanket of Comparative Example 4 corresponding to that of clam 1 of Japanese Laid-Open Patent Publication No. 297877/1994 are not superior in compression properties because the compressive stress to the amount of distortion is high in the initial stage of use and a fluctuation in compressive stress with a change in amount of distortion is large.

It has been found that the printing blanket of Comparative Example 3 corresponding to that of Japanese Examined Patent Publication No. 55519/1987 exhibits good compression properties in the initial stage of use because a fluctuation in compressive stress with a change in amount of distortion is smaller than that of the printing blanket of Comparative Example 2 as a conventional air-type printing blanket, however, large setting arises in the thickness direction as compared with the other printing blanket, as a result of repeated compression, and compression properties are deteriorated.

It has been found that, on the other hand, all of the printing blankets of Example 1 to 3 can reduce the compressive stress to the amount of distortion and reduce the fluctuation in compressive stress with a change in amount of distortion as compared with those of Comparative Example 1 and Comparative Example 4 in spite of its simple structure which is the same as that of Comparative Example 1 as a solid-type printing blanket. It has also been found that all of the printing blankets of the respective examples are also superior in durability because compression properties do not change largely by repeated compression and large setting does not arise in view of the appearance.

A comparison between the results of the above-mentioned respective examples was made. As a result, it has been confirmed that compression properties are improved as the number of the base fabric woven by using the hollow fiber increases and the printing blanket of Example 3 has the same compression properties as those of the air-type printing blanket of Comparative Example 2.

Furthermore, the printing blankets of Examples 2, 3 can perform good printing similar to the air-type printing blanket of Comparative Example 2 because the initial compressive stress at the amount of distortion of 0.15 mm corresponding to the thickness of a normal paper is within the ideal range from 60 to 15 kgf as shown in FIG. 7(*a*) and Table 1 mentioned below and, moreover, the compressive stress at the same amount of distortion after repeated compression maintains within the above range, as shown in FIG. 7(*b*) and Table 1 mentioned below.

TABLE 1

| | Compressive stress (kgf) | |
|---|---|---|
| | Initial | After repeated compression |
| Example 1 | 180 | 170 |
| Example 2 | 110 | 100 |
| Example 3 | 80 | 75 |
| Comp. Example 1 | 230 | 200 |
| Comp. Example 2 | 80 | 75 |
| Comp. Example 3 | 80 | 180 |
| Comp. Example 4 | 200 | 190 |

Example 4

Using a hollow fiber made of acrylic resin which is circular in cross section and has only one cavity circular in cross section provided continuously along its length in its central part [RX21 available from TOYOBO CO., LTD.; 50 μm in outside diameter and 20 μm in inside diameter at the cavity], a warp yarn made by twisting two hollow fibers and a weft yarn made by twisting two hollow fibers, a base fabric having a thickness of 0.1 mm was made by plain weaving.

Then, a sheet-shaped printing blanket having a laminated structure shown in FIG. 4(*a*), wherein the thickness of the surface printing layer is 0.4 mm, the total thickness is 1.7 mm, the number of the base fabric woven by using the hollow fiber is one, and the total thickness of the base fabric is 0.1 mm, was produced in the same manner as that in Example 1 except that one base fabric mentioned above and four cotton cloths having a thickness of 0.3 mm as a normal base fabric were laminated by spreading over an adhesive.

Example 5

Using the same hollow fiber as that used in Example 4, a warp yarn made by twisting six hollow fibers and a weft yarn made by twisting six hollow fibers, a base fabric having a thickness of 0.3 mm was made by plain weaving.

Using a hollow fiber made of polyester which is circular in cross section and has only one cavity circular in cross section provided continuously along its length in its central part [NEW S-UP available from TOYOBO CO., LTD.; 30 μm in outside diameter and 20 μm in inside diameter at the cavity], a warp yarn made by twisting six hollow fibers and a weft yarn made by twisting six hollow fibers, a base fabric having a thickness of 0.2 mm was made by plain weaving.

Then, a sheet-shaped printing blanket having a laminated structure shown in FIG. 4(*b*), wherein the thickness of the surface printing layer is 0.4 mm, the total thickness is 1.8 mm, the number of the base fabric woven by using the hollow fiber is two, and the total thickness of the base fabric is 0.5 mm, was produced in the same manner as that in Example 1 except that each one of these two kinds of base fabrics and three cotton cloths having a thickness of 0.3 mm as a normal base fabric were laminated by spreading over an adhesive.

Example 6

A sheet-shaped printing blanket having a laminated structure shown in FIG. 5(*a*), wherein the thickness of the surface printing layer is 0.4 mm, the total thickness is 1.9 mm, the number of the base fabric woven by using the hollow fiber is three, and the total thickness of the base fabric is 0.9 mm, was produced in the same manner as that in Example 1 except that three base fabrics having a thickness of 0.3 mm as that used in Example 5, and two cotton cloths having a thickness of 0.3 mm as a normal base fabric were laminated by spreading over an adhesive.

Example 7

Using the same hollow fiber as that used in Example 4, a warp yarn made by twisting eight hollow fibers and a weft yarn made by twisting eight hollow fibers, a base fabric having a thickness of 0.4 mm was made by plain weaving.

Then, a sheet-shaped printing blanket having a laminated structure shown in FIG. 5(*b*), wherein the thickness of the surface printing layer is 0.4 mm, the total thickness is 2.0 mm, the number of the base fabric woven by using the hollow fiber is four, and the total thickness of the base fabric is 1.3 mm, was produced in the same manner as that in Example 1 except that one base fabric having a thickness of 0.4 mm mentioned above, three base fabrics having a thickness of 0.3 mm as that used in Example 5, and one cotton cloth having a thickness of 0.3 mm as a normal base fabric were laminated by spreading over an adhesive.

Example 8

A sheet-shaped printing blanket having a laminated structure shown in FIG. 3(*c*), wherein the thickness of the surface printing layer is 0.4 mm, the total thickness is 1.9 mm, the number of the base fabric woven by using the hollow fiber is four, and the total thickness of the base fabric is 1.5 mm, was produced in the same manner as that in Example 1 except that one base fabric having a thickness of 0.3 mm as that used in Example 5, and three base fabrics having a thickness of 0.4 mm as that used in Example 7, were laminated by spreading over an adhesive.

The above-mentioned tests were conducted with respect to each of the printing blankets produced in the above-mentioned examples to evaluate the properties thereof. The measured results of an initial compressive stress and a compressive stress after repeated compression at the amount of distortion of 0.15 mm corresponding to a normal thickness of a paper are shown in Table 2 below, together with the total thickness Th (mm) of the above-mentioned base fabric made of the hollow fiber.

TABLE 2

| | Th | Compressive stress (kgf) | |
|---|---|---|---|
| | (mm) | Initial | After repeated compression |
| Example 4 | 0.1 | 220 | 210 |
| Example 5 | 0.5 | 140 | 132 |
| Example 6 | 0.9 | 100 | 94 |
| Example 7 | 1.3 | 70 | 65 |
| Example 8 | 1.5 | 60 | 56 |

It has been confirmed from the above table that the larger the total thickness Th (mm) of the base fabric made of the hollow fiber, the more the initial compressive stress and compressive stress after repeated compression are lowered.

It has been found that the printing blankets of Examples 6 to 8 are capable of performing good printing similar to the air-type printing blanket of Comparative Example 2 because the above initial compressive stress is within the range from 60 to 150 kgf mentioned above and, moreover, the compressive stress after repeated compression is maintained within the same range.

Although the present invention has been described and illustrated in detail, it is clearly understood that the same is by way of illustration and example only and is not to be taken by way of limitation, the spirit and scope of the present invention being limited only by the terms of the appended claims.

The disclosure of Japanese Patent Application Serial No.9-277769, filed on Sep. 10, 1997, is incorporated herein by reference.

What is claimed is:

1. A sheet-shaped printing blanket comprising a surface printing rubber layer and at least one base fabric layer wherein the base fabric layer is a woven textile having hollow fibers in at least one of the warp or weft yarns in whole or in part.

2. The sheet-shaped printing blanket according to claim 1, wherein at least one of warp and weft yarns is formed by twisting a plurality of hollow fibers.

3. The sheet-shaped printing blanket according to claim 1, comprising a plurality of base fabric layers, at least one of which is composed of hollow fibers in whole or in part, wherein the respective base fabric layers are laminated and bonded to each other through an adhesive containing a vulcanizable rubber.

4. The sheet-shaped printing blanket according to claim 3, wherein the surface printing layer and base fabric layers are laminated and bonded to each other through an adhesive containing a vulcanizable rubber.

5. The sheet-shaped printing blanket according to claim 3, wherein the number of the base fabric layers composed of hollow fibers in whole or in part is from 1 to 4 and the total thickness is from 0.1 to 1.5 mm.

6. The sheet-shaped printing blanket according to claim 5, wherein the base fabric layer is a textile wholly formed of woven hollow fibers.

7. The sheet-shaped printing blanket according to claim 3, wherein the base fabric layer is a textile wholly formed of woven hollow fibers.

8. The sheet-shaped printing blanket according to claim 1, wherein the base fabric layer is a textile wholly formed of woven hollow fibers.

9. The sheet-shaped printing blanket according to claim 1, wherein the hollow fibers are formed of polyester, acrylic resin, rayon, nylon, or aromatic polyamide.

10. The sheet-shaped printing blanket according to claim 9, wherein the base fabric layer is a textile wholly formed of woven hollow fibers.

11. The sheet-shaped printing blanket according to claim 9, wherein the hollow fibers have an outer diameter of from about 10 to 50 microns and an inner diameter of from about 5 to 30 microns.

12. The sheet-shaped printing blanket according to claim 1, wherein the hollow fibers have an outer diameter of from about 10 to 50 microns and an inner diameter of from about 5 to 30 microns.

13. The sheet-shaped printing blanket according to claim 12, wherein the base fabric layer is a textile wholly formed of woven hollow fibers.

* * * * *